United States Patent [19]

Sundstrom

[11] 4,056,894

[45] Nov. 8, 1977

[54] METHOD OF PRODUCING A CARD FILE

[76] Inventor: Edward K. Sundstrom, Box 338, Pennington, N.J. 08534

[21] Appl. No.: 653,898

[22] Filed: Jan. 30, 1976

[51] Int. Cl.[2] ..... B42F 15/00
[52] U.S. Cl. ..... 40/104.03
[58] Field of Search ..... 40/104.03, 104.06, 104.09, 40/104.12, 104.17–104.19, 124, 124.4, 78; 206/44 B, 425, 486, 487, 489, 464

[56] References Cited

U.S. PATENT DOCUMENTS

| | | | |
|---|---|---|---|
| 1,857,229 | 5/1932 | Wood | 40/104.09 X |
| 3,292,632 | 12/1966 | Hopen | 40/104.19 X |

*Primary Examiner*—Louis G. Mancene
*Assistant Examiner*—Mickey Yu
*Attorney, Agent, or Firm*—Thomas A. Lennox

[57] ABSTRACT

A novel card file is provided of a substantially rigid sheet having a plurality of parallel tandem slits. The length of the slits is slightly less than the length of the cards. Standard index cards without notches or cut-outs, are inserted, lined up parallel into the slits, and pressed into place providing a flippable card file.

11 Claims, 6 Drawing Figures

Fig. 3
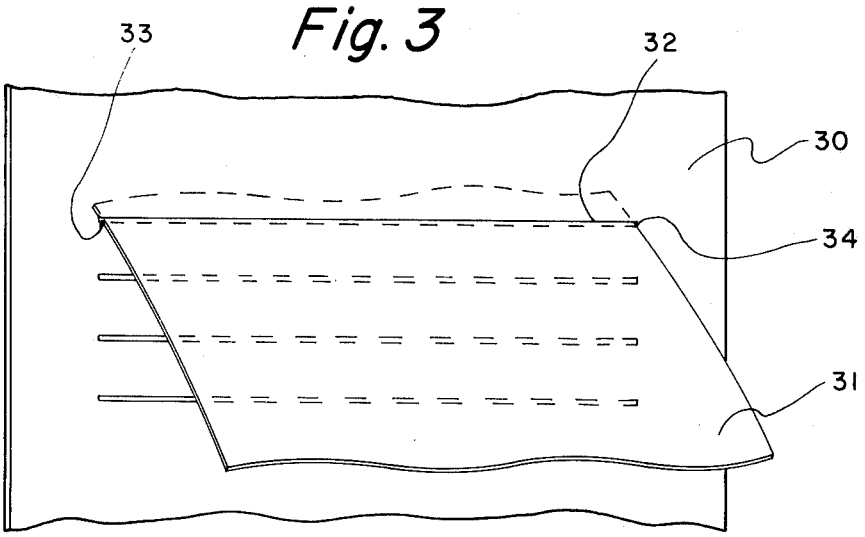
Fig. 4
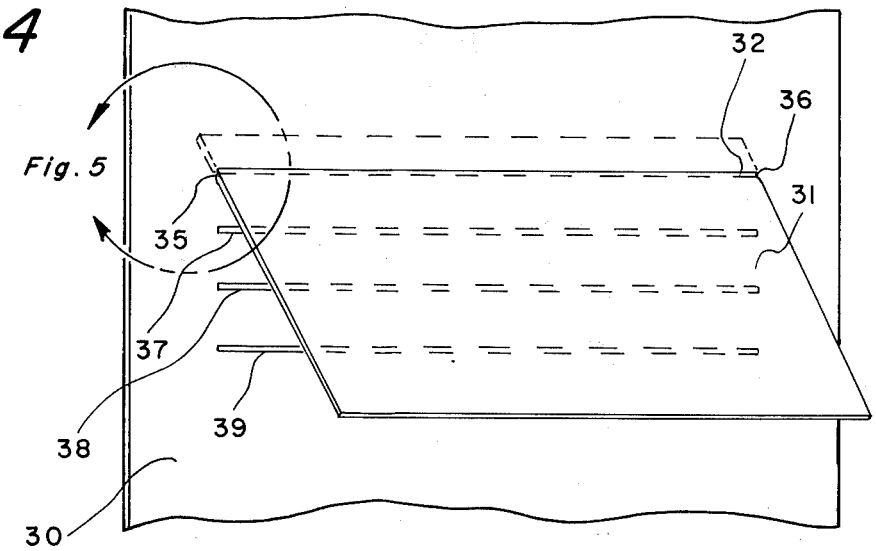
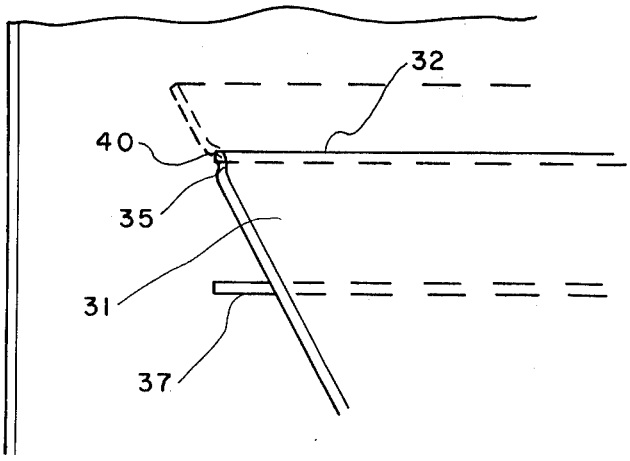
Fig. 5

METHOD OF PRODUCING A CARD FILE

BACKGROUND OF INVENTION

This invention is directed to the stationery field and in particular card files which hold the card but allow it to be flipped and read on both sides.

There is a particular need for a card file that is portable and may be used by students to organize research materials and notes that may be collected on standard index cards. It would be particularly useful to have a card file which would be capable of insertion in a standard loose-leaf ring notebook. U.S. Pat. No. 3,292,632 to Hopen discloses a card file that might at first glance appear to fill this need. The Hopen invention has a basic deficiency. As with most card files, there is an attempt to prevent the cards from dropping out of the file. Hopen suggests that the problem is solved by notching or preshaping the index cards. This costly and very inconvenient method essentially eliminates the utility of such an invention. Pre-notching is not practical to the supplier or the user for general usage. Card file systems as described in U.S. Pat. No. 2,530,604 to Emblen and U.S. Pat. 2,318,489 to Iuculano have similar deficiencies. There are many additional card filing systems utilizing cards having notches, slits, slots, pockets or tabs to hold the cards in position and prevent the inadvertent misplacement. U.S. Pat. No. 697,592 to Zevy discloses leafs with tabs which fit into slots and are glued in place to hold the leaf in place.

In these disclosures the cards have specially formed notches, tabs or whatever. The card width when referred to the depth of the notches, slots, slits or whatever is less than the length of the slot into which the card is to be inserted. By leaving an extension longer than the slot, the card is held in place and prevented from being inadvertently removed.

It is an object of this invention to provide a card file which holds the cards in place, and prevents cards from inadvertent removal.

It is an additional object of this invention to provide a card file wherein the cards may be flipped over to uncover the card below and to observe or write on both sides of the cards.

It is a primary object of this invention to provide a card file that holds the cards in place, which utilizes standard index cards that may be purchased in any stationery store and used in the invention with no modification.

It is an additional object of this invention to provide a card file which stores the index cards on a substantially rigid sheet which may be further stored in a binder, such as a standard ring binder.

It is an additional object of this invention to provide a card file which may be incorporated, as part of another item such as of a spiral notebook or ring binder.

It is an additional object of this invention to provide a card file which permits standard index cards to be inserted, stored, viewed from either side, removed, rearranged or replaced at the will or desire of the user.

It is an additional object of this invention to provide a convenient, inexpensive, and yet durable card file which may be utilized by students and others using essentially all standard materials available in stationery stores.

These and other objects have been attained in the present invention which accomplishes the needs described above.

SUMMARY OF THE INVENTION

The above objects are accomplished by preparing a substantially rigid sheet which will ultimately hold the index cards by cutting a plurality of parallel tandem slits in the sheet. The number of slits will normally be equal to the number of cards that may be held on the sheet, however, it is quite possible to place more than one card in each slit. It is critical that the slit length be slightly shorter than the width of the index card to be inserted. An indenting means is provided at the ends of the slits. The indenting means includes the use of material or combination of materials that has an edge hardness greater than the index cards.

The index card file is produced by taking a substantially rigid sheet and cutting therein parallel tandem slits, the length of said slits being slightly shorter than the index card width to be inserted. An indenting means is at each end of the slits, this indenting means providing an edge harder than the index card stock. The index cards are placed in the slits, but they will bow slightly due to their being slightly longer than the length of the slits. Pressure is placed in the center of the index cards and then, without releasing the pressure, the pressure is moved out toward the edges of the cards to seat the cards in the slit. In this fashion holding and hinge points are formed in the cards allowing them to be flipped over and handled without inadvertent loss. The index cards may be removed and then reinserted using the same or different hinge points.

DESCRIPTION OF PREFERRED EMBODIMENTS

Figure 1:
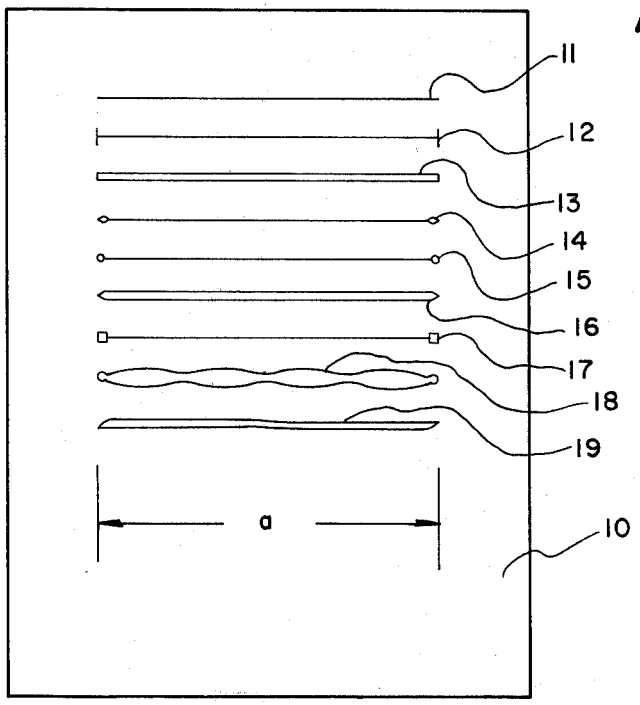

Throughout the specification there is reference to index cards to be used in and with this invention. That terminology is in no way intended to limit the scope of the invention as the invention is effective to file all card stock or similar items which are sufficiently rigid to hold their shape and yet be of sufficiently low edge hardness as to be utilized in this invention. While the invention is particularly effective for index card stock, the invention may store card stock, manila stock, red fiber stock, kraft stock, jute stock, pressboard, paperboard, cardboard, plastic sheets and like materials. The invention is particularly effective for use with 3 inch by 5 inch standard index cards.

The substantially rigid sheet or card file stock is the supporting member that holds the index cards. The rigidity of this sheet depends upon the material used, the density of that material, the thickness of the material and any reinforcement of that material, either internally or externally. It will be clear from the disclosure that effective card files may be constructed using sheets of plastic, such as unplasticized polyvinyl chloride, cellulose acetate, and other plastic sheets of similar physical characteristics. Card files may also be constructed from pressboard, paperboard, metal sheets, such as aluminum or steel, and any other sheets of material that have an effective edge hardness greater than that of index card stock. Particularly preferred is 15 mil thick plastic sheets such as unplasticized polyvinyl chloride sheet.

Reference is made throughout the disclosure to the term "edge hardness". This term is not necessarily intended to refer to a specific testing method, although standardized tests will illustrate the physical characteristic. For the purpose of this invention, the term is intended to be a comparative test between the end of the slits in the card file stock with the edge of the index card stock. Thus, when the edge of the index card stock is abutted at an angle against the edge of the card file stock, the edge hardness is determined by pressing the two edges together firmly. If sufficient pressure is exerted, either or both of the edges will deform significantly. The material for the card file stock is effective as an indenting means, if the only significant deformation is that of the index card stock.

In some embodiments of this invention, reinforcement is used to form the indenting means. That reinforcement may be formed, cast, molded, or adhesively attached to the card file stock at the ends of the slits. A particularly effective reinforcement is a strip of plastic, such as cellulose acetate, adhesively attached perpendicular to the slits along the edges of the slits. For example, a strip of cellulose acetate of a thickness of one to twenty mils, is effective to reinforce the slit ends to form the indenting means. Cellulose acetate strips, fifteen mils thick, are particularly effective as reinforcements to form the indenting means.

The particular width of the slits is not critical to this invention. The width of the slits does effect the performance to varying degrees, depending upon the card file stock, the index card material, and the use to which the card file is intended. A knife cut slit is satisfactory. It is preferred that the width of the slit be up to ten times the thickness of the index card stock. It is more preferred that the width of the slits be up to five times that of the thickness of the index card stock.

The length of the slits is critical to the present invention. It is critical that the slit length be slightly shorter than the width of the cards to be inserted and held. It is preferred that the slit length be one-thirty second to one-eighth inch shorter than the width of the cards to be inserted. It is more preferred that the slit length be three sixty-fourths to three thirty-seconds of an inch less than the index card length. It is most preferred that the slit be one-sixteenth of an inch less than the width of the index card or item to be inserted. It should be understood that the slit length is as modified by any reinforcement required in order to form the indentation and hinge points in the index cards.

FIG. 1 is a diagram showing various slits and constructions which are suitable for use with this invention. The diagrams of FIG. 1 show the cuts necessary to form the slits and it should be realized that file card stock 10 is actually three dimensional but that dimension is not necessary to illustrate these forms. Slit end 11 is the knife edge cut merely terminated to form the end. Slit end 12 is formed by an extra cut perpendicular to the slit length. Slit end 13 illustrates a slit with increased width and is not necessarily drawn to scale. Slit end 14 illustrates a knife cut slit with a diamond cut end to form a particular hinge point. Slit end 15 illustrates a knife cut slit with a round hole end. Slit end 16 illustrates a widened slit narrowed to a hinge point at the end of the slit, to form a particular hinge point. Slit end 17 is a knife cut slit with a square end cut. The exact shape and construction of the end of the slit depends upon the material utilized in the card file stock and the use to which the card file is intended. The shape of the slits and the termination points that may be utilized in this invention include those disclosed in U.S. Pat. No. 3,292,632 to H. M. Hopen, however, the width of the slit, the shape of the ends of the slit and the shape of the slit is not critical to this invention. Slits 18 and 19 are illustrated in Hopen, supra. Slit length "*a*" is critical as to the invention.

Figure 2:
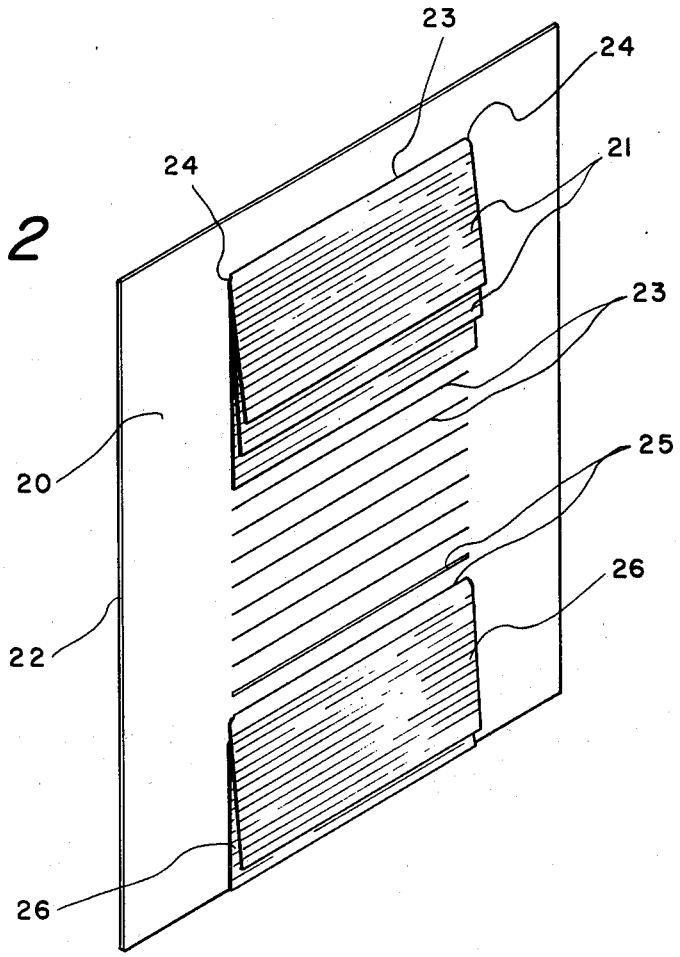
Figure 6:
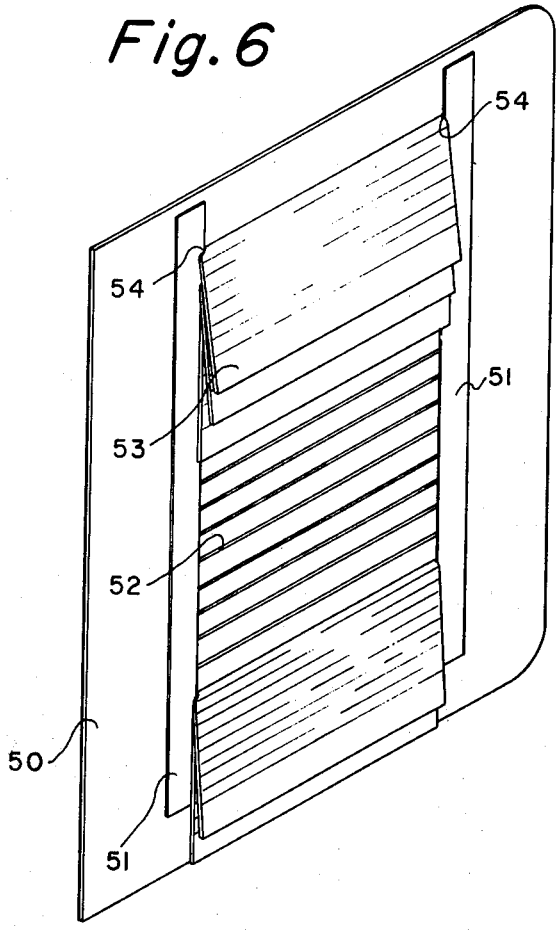

FIG. 2 is a perspective view of card file 20. Standard three inch by five inch index cards 21 are held on fifteen mil unplasticized polyvinyl chloride sheet 22, also referred to as card file stock 22. Parallel tandem knife-thin slits 23 are cut in card file stock 22. The length of slits 23 are one-sixteenth of an inch less than the actual width of the three inch by five inch standard index card. The distance between the tandem parallel slits is equal to or greater than the distance beween the top of the index cards and hinge points 24 formed in the cards. Obviously, this latter distance is not critical and can be varied widely depending upon the number of cards to be held in the card file. In card file 20, the distance between the parallel slits is about one-half inch so that forming hinge points 24 on the red line of the standard ruled three by five index cards will not cause binding when cards 21 are flipped over.

Although different width slits will not generally be provided on the same card file, wider slits 25 are illustrated. Slits 25 are 25 mils wide to allow cards 26 to flip over freely.

FIG. 3 is a perspective view in a larger scale showing the card file 30 similar to that shown in FIG. 2. Index card 31 in inserted into slit 32 before the indenting of the hinge points. Slit 32 is about ten mils wide. Slit 32 is about one-sixteenth inch shorter in length than the actual five inch width of index card 31. Index card 31 is slightly warped since it is longer than the length of slit 32.

By pressing in the center of card 31 along slit 32 and continuing the pressure outwardly along the slit to the ends of slit 32, card 31 becomes slightly deformed at points 33 and 34 touching the ends of slit 32. This deformation to form holding and hinge points 35 and 36 is illustrated in FIG. 4. Card 31 is shown inserted in slit 32 which is similar to other tandem slits 37, 38 and 39. After hinge points 35 and 36 are formed in index card 31, the card is essentially flat, but is held securely at hinge points 35 and 36 and will not fall out due to inadvertent handling. The card is removable by bending index card 31.

FIG. 5 is an expanded view of hinge point 35 shown on FIG. 4. Card 31 is inserted in slit 32 and pressed to form hinge point 35. The hinge point is formed by deformation against end 40 of slit 32 which is of sufficient edge hardness to essentially only deform file card 31.

While I have described my invention in connection with specific embodiments, it is to be clearly understood that this description is made only by way of example and not as limitation to the scope of my invention as set forth in the following claims.

I claim:

1. A method of producing a card file comprising:
   a. cutting parallel tandem slits in a substantially rigid sheet,
   b. the slit length being slightly shorter than the width of the cards to be inserted therein,
   c. providing indenting means at the ends of the slits,
   d. placing cards, one or more to each slit, which will bow slightly due to their being slightly longer than the length of the slits,
   e. pressing on the cards in the center and sliding the pressure out toward the edges of the cards to seat the cards in the slit and indenting them to form holding and hinge points in the cards.

2. The method of claim 1, wherein the indenting means is the use of sheet material with a greater edge hardness than the cards.

3. The method of claim 1 wherein the indenting means is utilizing a thickness and composition combination for the substantially rigid sheet such that when the edge of the substantially rigid sheet is pressed against the edge of the card, essentially only the card is indented.

4. The method of claim 1 wherein the substantially rigid sheet is a plastic sheet.

5. The method of claim 4 wherein the substantially rigid plastic sheet is polyvinyl chloride sheet.

6. The method of claim 1, wherein the indenting means is reinforced by the lamination of a combination of materials, the combination of which has an edge hardness greater than that of index card stock.

7. The method of claim 1, wherein the width of the slits is up to ten times the thickness of an index card.

8. The method of claim 1, wherein the width of the slits is up to five times the thickness of index card stock.

9. The method of claim 1 wherein the number of slits is the number of cards to be held in the file and the distance between the slits is equal to or greater than the distance from the top of the index card to the place of indentation.

10. The method of claim 1 wherein the slits are widened to the approximate thickness of the cards to be inserted therein.

11. A method of producing a card file comprising:

a. cutting a plurality of parallel tandem slits in a substantially rigid sheet of polyvinyl chloride polymer, wherein the width of the slits is approximately equal to the thickness of cards to be inserted therein, and wherein the slit length is slightly shorter than the width of the cards to be inserted therein, b. providing indenting means at the ends of the slits, c. placing cards in the slits one or more to each slit, whereby the cards will bow slightly due to their being slightly longer than the length of the slits, d. pressing on the cards in the center and sliding the pressure out toward the edges of the cards to seat the cards in the slit and indenting them to form holding and hinge points in the cards.

* * * * *